US006120016A

United States Patent [19]

Watkiss

[11] Patent Number: 6,120,016

[45] **Date of Patent: *Sep. 19, 2000**

[54] APPARATUS FOR FEEDING SHEET MATERIAL

[75] Inventor: Christopher Robin Watkiss, Biggleswade, United Kingdom

[73] Assignee: Watkiss Automation Limited, Bedfordshire, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/732,494

[22] PCT Filed: Mar. 18, 1996

[86] PCT No.: PCT/GB96/00631

§ 371 Date: Oct. 15, 1996

§ 102(e) Date: Oct. 15, 1996

[87] PCT Pub. No.: WO96/29270

PCT Pub. Date: Sep. 26, 1996

[30] Foreign Application Priority Data

Mar. 18, 1995 [GB] United Kingdom ..... 9505502

[51] Int. Cl.[7] ..... B65H 3/32

[52] U.S. Cl. ..... 271/19; 271/20; 271/106; 271/161

[58] Field of Search ..... 271/10.1, 94, 98, 271/99, 105, 106, 197, 19, 20, 16, 161, 34

[56] References Cited

U.S. PATENT DOCUMENTS

| | | | |
|---|---|---|---|
| 4,336,929 | 6/1982 | Hanzlik | 271/106 |
| 4,595,190 | 6/1986 | Amarakoon | 271/94 |
| 4,596,385 | 6/1986 | Silverberg | 271/98 |
| 4,831,419 | 5/1989 | Iaia, Jr. et al. | 271/197 |
| 4,887,805 | 12/1989 | Herbert et al. | 271/98 |
| 5,052,675 | 10/1991 | Shehata et al. | 271/94 |
| 5,090,676 | 2/1992 | Matsuno et al. | 271/94 |
| 5,392,107 | 2/1995 | Paxon et al. | 271/197 |
| 5,478,066 | 12/1995 | Yoshida et al. | 271/94 |
| 5,499,806 | 3/1996 | Bourg | 271/9.11 |

FOREIGN PATENT DOCUMENTS

| | | |
|---|---|---|
| 0 465 062 | 1/1992 | European Pat. Off. . |
| 0 598 272 | 5/1994 | European Pat. Off. . |

*Primary Examiner*—Christopher P. Ellis
*Assistant Examiner*—Patrick Mackey
*Attorney, Agent, or Firm*—Seidel, Gonda, Lavorgna & Monaco, PC

[57] ABSTRACT

A suction device for feeding sheets of material comprises a housing (38) connectable by a pipe (40) to a vacuum device and having apertures **(54*a*, 54*b*, 54*c*, 54*d*, 58) through which a suction effect can be created. An eccentric roller (46)** imparts a corrugation to the attracted sheet. The apertures are shaped and located so that there is a boost in the suction exerted on the sheet at the time that it is distorted. Continuous and pulsed air flows are used as well as aids to separate sheets individually from a stack.

17 Claims, 5 Drawing Sheets

APPARATUS FOR FEEDING SHEET MATERIAL

This invention relates generally to suction feeder mechanisms for the feeding of sheet material and to methods of feeding sheet material. The suction feeders of the present invention are particularly adapted for use with collating machines, but the principles of the invention have much wider application to any circumstance where one wishes to feed sheets of material, whether paper or other materials.

It is emphasised that the present invention is applicable not only to collating machines but also to photocopiers, printers, and indeed any other mechanism where sheets of material are to be moved around.

In the feeding of sheet material it is desirable that there should be no misfeeds or double feeds. It is also desirable that the mechanism should be able reliably to feed sheets of different types of material. Although there are suction feeder mechanisms which function with reasonable reliability in terms of avoiding misfeeds and double feeds, or else incorporate sensors to detect if and when such faults occur, particular problems arise if one is designing one mechanism which is intended to be able to feed sheet material of different thicknesses and compositions.

EP-B-0465062 describes a top sheet vacuum corrugation feeder with an air knife in the form of a single slot which supplies air at low pressure across the entire width of the sheet to create a thick boundary layer which causes separation of the sheets by aerodynamic drag during feeding of the top sheet.

EP-A-0619259 describes a top sheet feeder mechanism which has a corrugator in the centre of a plurality of perforated belts which move around a plenum chamber. The corrugator is an endless band which extends around the full length of the plenum chamber, and hence is not adjustable. Air is supplied to the region between the underside of the belts and the surface of the top sheet, to assist in the separation of the sheets. The bottom run of the belts and the surface of the top sheet are parallel and their separation is maintained constant by the use of a movable tray on which the sheets are stacked.

It is an object of the present invention to provide a suction feeder mechanism and a method which can reliably feed sheets of material with greatly reduced likelihood of misfeeds or double feeds.

It is a further object of the invention to provide a mechanism and a method which enables one to feed sheet material which can vary from for example thin paper up to thick sheets of plastics material which are subject to a large electrostatic charge. Sheets of plastics material are particularly difficult to feed reliably, due to the build-up of electrostatic charges, and this has created particular problems in the past. The present invention solves or at least minimises these problems.

The sheet feed of the present invention has many attributes:

a) it is very economical;

b) it does not require adjustments over a wide range of materials and sheet sizes;

c) it is rugged and reliable;

d) it operates without creasing or marking the sheets;

e) it provides a very positive feeding mechanism;

f) because of the very small amount of movement of paper and of the mechanism itself, it is possible for it to be not only very economical but also very fast.

The sheet feeder mechanism of the present invention in its broadest aspect utilises a suction device which both includes means to impart distortion to a sheet attracted to the suction device, and also provides a novel suction effect which aids the maintenance of the sheet in the correct position and attitude for onward movement.

The novel suction device is utilised, as part of the sheet feeder mechanism, in conjunction with a multiple air flow which assists in the separation of the top sheet from a stack.

In accordance with the invention there is provided a suction device for use in the feeding of sheets of material, comprising a housing connectable to a vacuum device and having a flat surface provided with apertures through which a suction effect can be created to attract a sheet towards said surface, and means prominent from said surface to impart distortion to an attracted sheet, wherein the apertures in said surface are such that there is a boost in the suction exerted on the attracted sheet at the time that it is distorted.

Preferably, the distortion-imparting means is adjacent to the leading edge of the housing from which the sheet is fed onwards, and the surface area of said apertures is greatest in the zone to each side of said distortion-imparting means.

Preferably, the apertures in the housing surface are of chevron shape overall.

In a preferred embodiment, the apertures comprise a plurality of parallel slots, with longer slots towards the outside edges of the housing and shorter slots towards the centre.

The invention also relates to a suction head comprising one such suction device, with an endless belt on which the sheet is held encompassing the housing and arranged for intermittent advancing movement.

The invention also relates to a sheet feeding mechanism comprising such a suction head, means to support a stack of sheets adjacent to the belt, and a vacuum device connected to the housing and synchronised to operate in conjunction with advancing movements of the belt.

Preferably, the means to support the stack of sheets holds the sheets at an inclined feed angle related to an adjacent run of the belt.

In a preferred embodiment the sheet feeding mechanism includes air supply means to provide both a pulsed and a continuous flow of air towards the stack of sheets.

Preferably, a first continuous air flow is directed upwards at the leading edge of the stack, a second continuous air flow is directed towards the top sheet of the stack substantially parallel thereto, and a pulsed air flow is directed towards the leading edge of the top sheet in synchronism with the operation of the vacuum device and with the belt movements.

The advancing motion of the sheet material is synchronised with the timed application of suction preferably assisted by the external air flow which is preferably both pulsed and continuous. The timed application of suction is synchronised with an advancing movement of the belt.

The suction feeder is preferably positioned above the stack of sheets of material, with the sheets being lifted into contact with the belt for advancing movement.

Preferably, the sheets below the top sheet are positively restrained from movement towards the belt, for example by pivotable contact fingers.

Once set, the suction feeder of the present invention will function just by the timed application of suction and the driving of the belt. Adjustment of the feeder for different types of sheet material can be effected simply by adjustment of the distortion-creating means, for example by simple rotation of an eccentrically mounted wheel or roller.

In an arrangement where an endless perforated belt is movable around a pair of spaced rollers, the means to create the distortion is preferably positioned towards that roller which is adjacent to the forward or leading end of the sheet stack. The distortion is then initiated towards the leading edge of the sheet which is being attracted from the stack.

Uniquely, the feed system requires no adjustment when changing paper sizes. One can cater for sheet sizes from 130×160 mm to 364×520 mm for example. One can use sheets from 40 to 240 gms.

In order that the invention may be more fully understood, an embodiment of sheet feeding mechanism in accordance with the invention will now be described by way of example and with reference to the accompanying drawings, in which.

In the various drawings the same parts are denoted by the respective same reference numerals.

Figure 5:
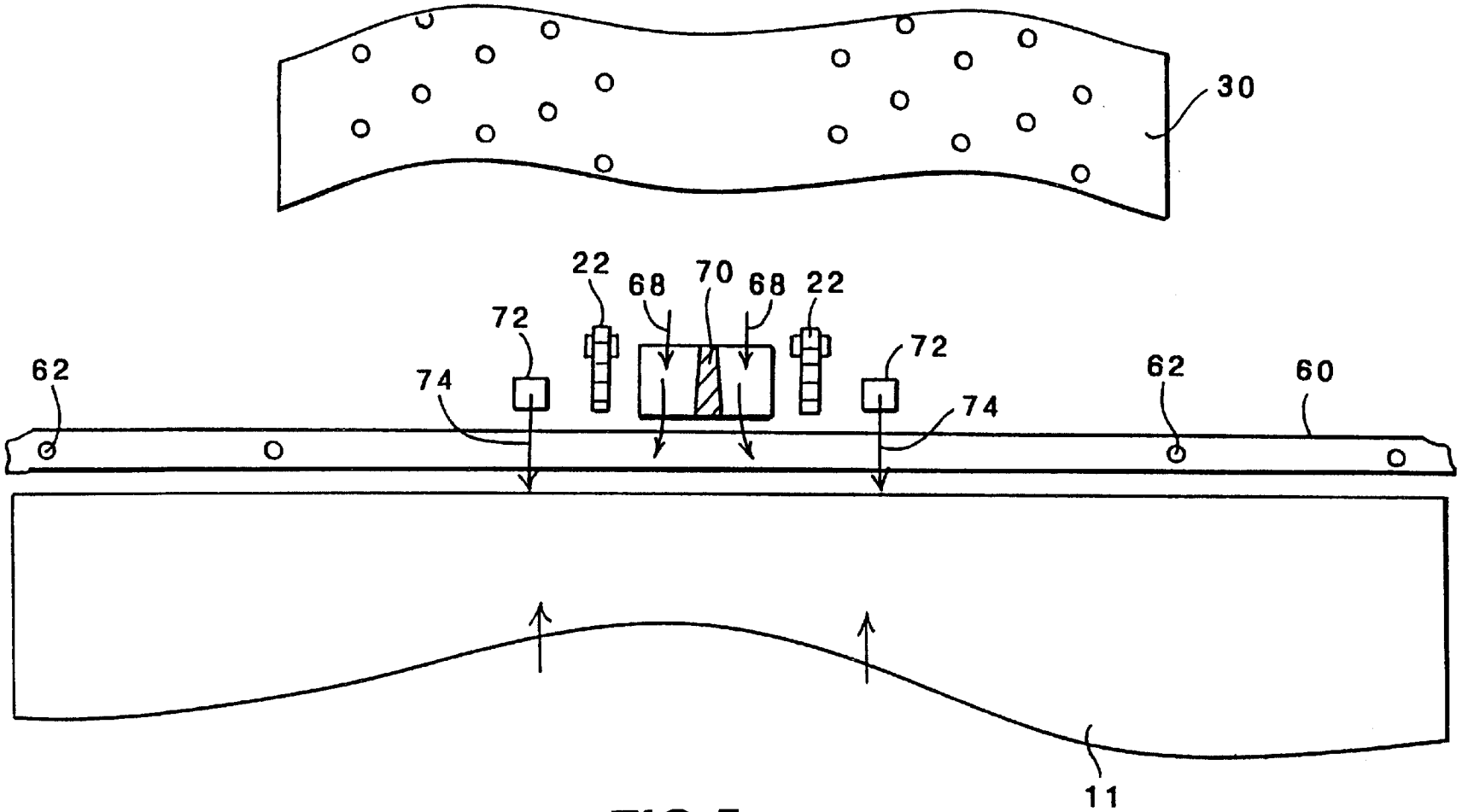

The sheet feeding mechanism shown in the drawings comprises a suction head, indicated generally at 10, which is designed and arranged to receive individual sheets 11 of paper, card, film or other like material from a stack 12 of sheets which are set on a supporting plate 14. In contrast to conventional suction feeders, the sheets in the stack 12 do not lie parallel to the underside of the suction head 10 but are set at a feed angle $\alpha$ with the leading edges of the sheets extending downwards away from the suction head. This feed angle $\alpha$ is preferably within the range of 5° to 15°, preferably about 10°. The suction head 10 will be described in detail hereinafter. Each sheet 11, as it is picked up and fed forward, is guided by guides 16, 18 to move forwards and then downwards between rollers 19, 20, 21. In front of the sheet stack 12 are a pair of fingers 22 which are pivotable and are positioned quite close to the centre of the stack width, as can be seen in FIG. 5. These serve as stops for sheets other than the topmost sheet and each has a serrated upper surface over which the sheet being fed will pass.

The suction head 10 comprises a suction box 24 which is fitted with a front drive roller 26 and a rear idler roller 28. Around the rollers and box runs an endless belt 30, intermittently driven. The rear idler roller 28 is fitted with a cam 32 which is engaged by a cam 34 which is pivotable about a pivot pin 36. By pivotal movement of cam 34 the rear edge of the suction head 10 can be raised and lowered to alter the feed angle $\alpha$.

Figure 1:
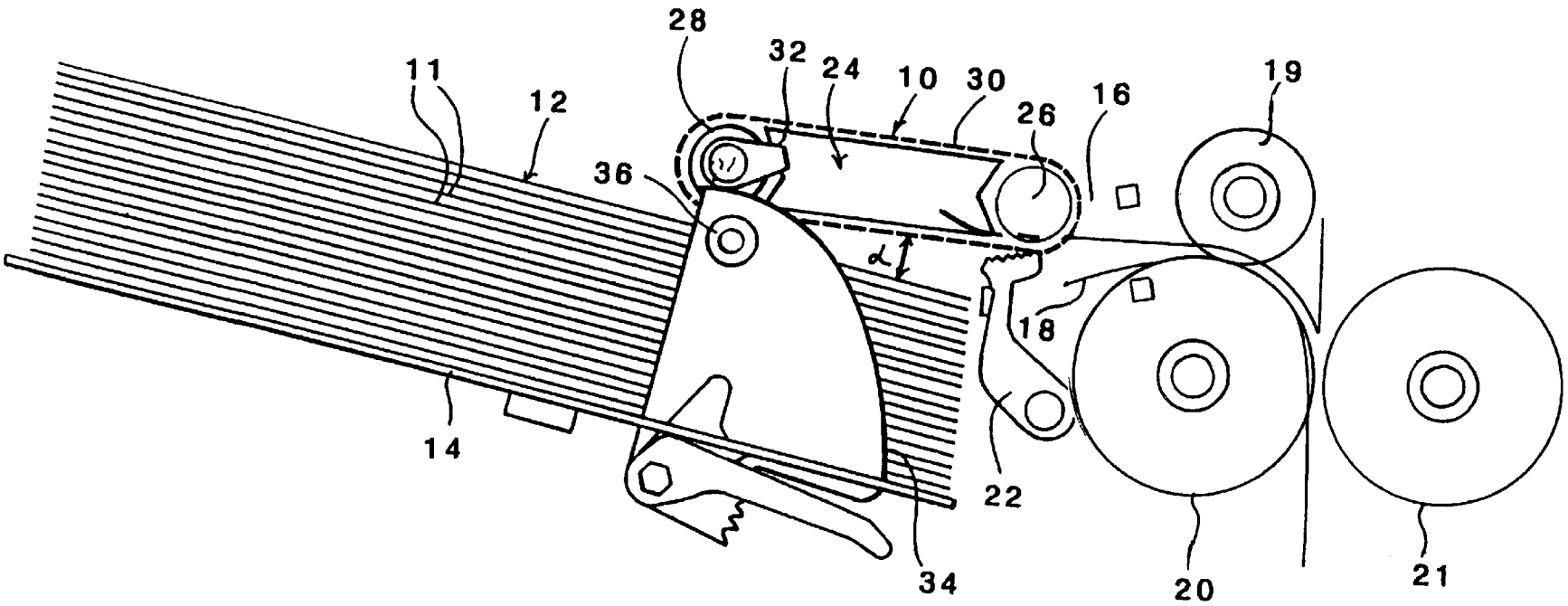
FIG. 1 is a schematic side view of the feeder mechanism to illustrate the feed system.
Figure 2:
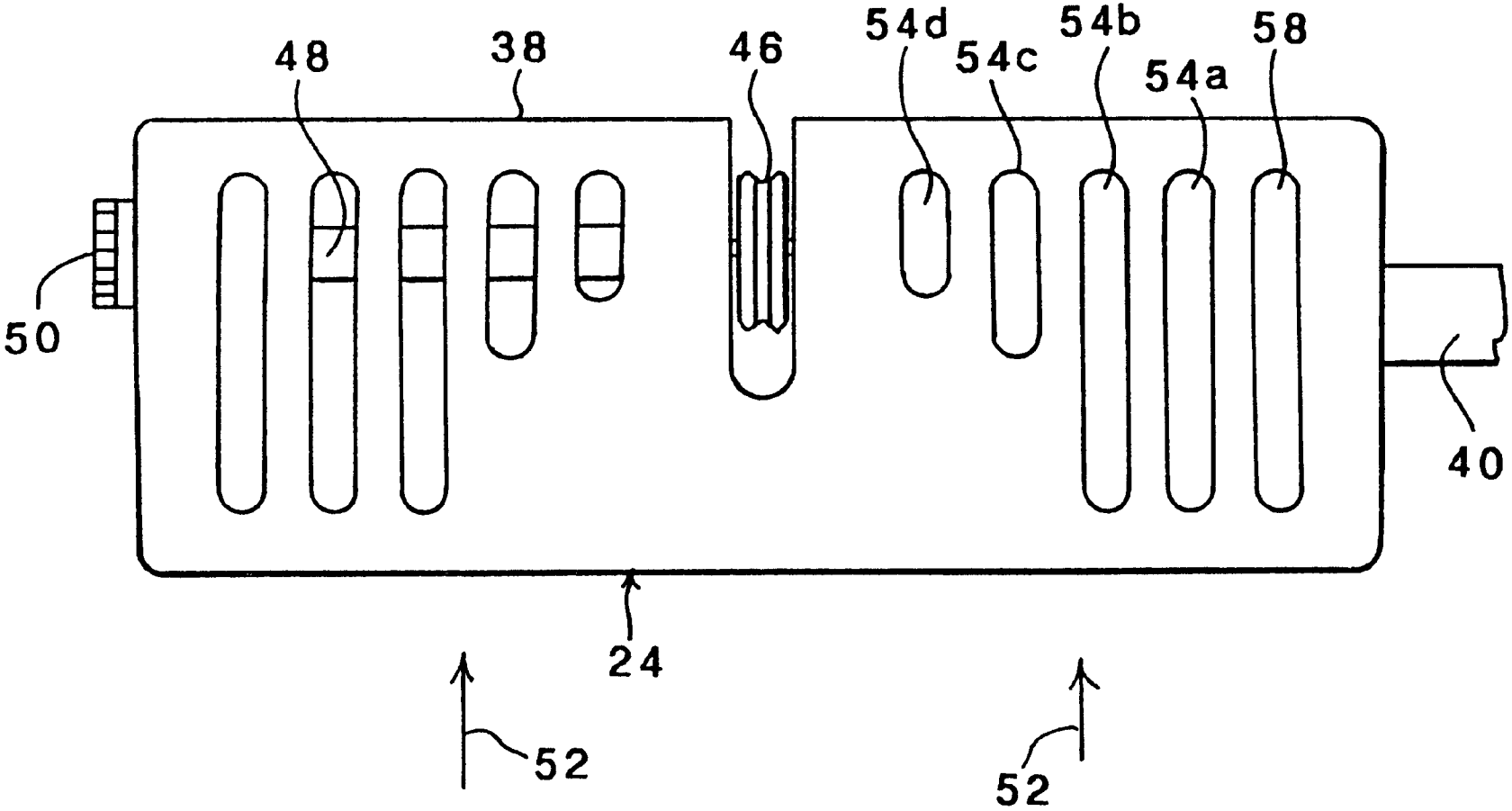
FIG. 2 is an underneath plan view of the suction box around which the feed belt travels.
Figure 3:
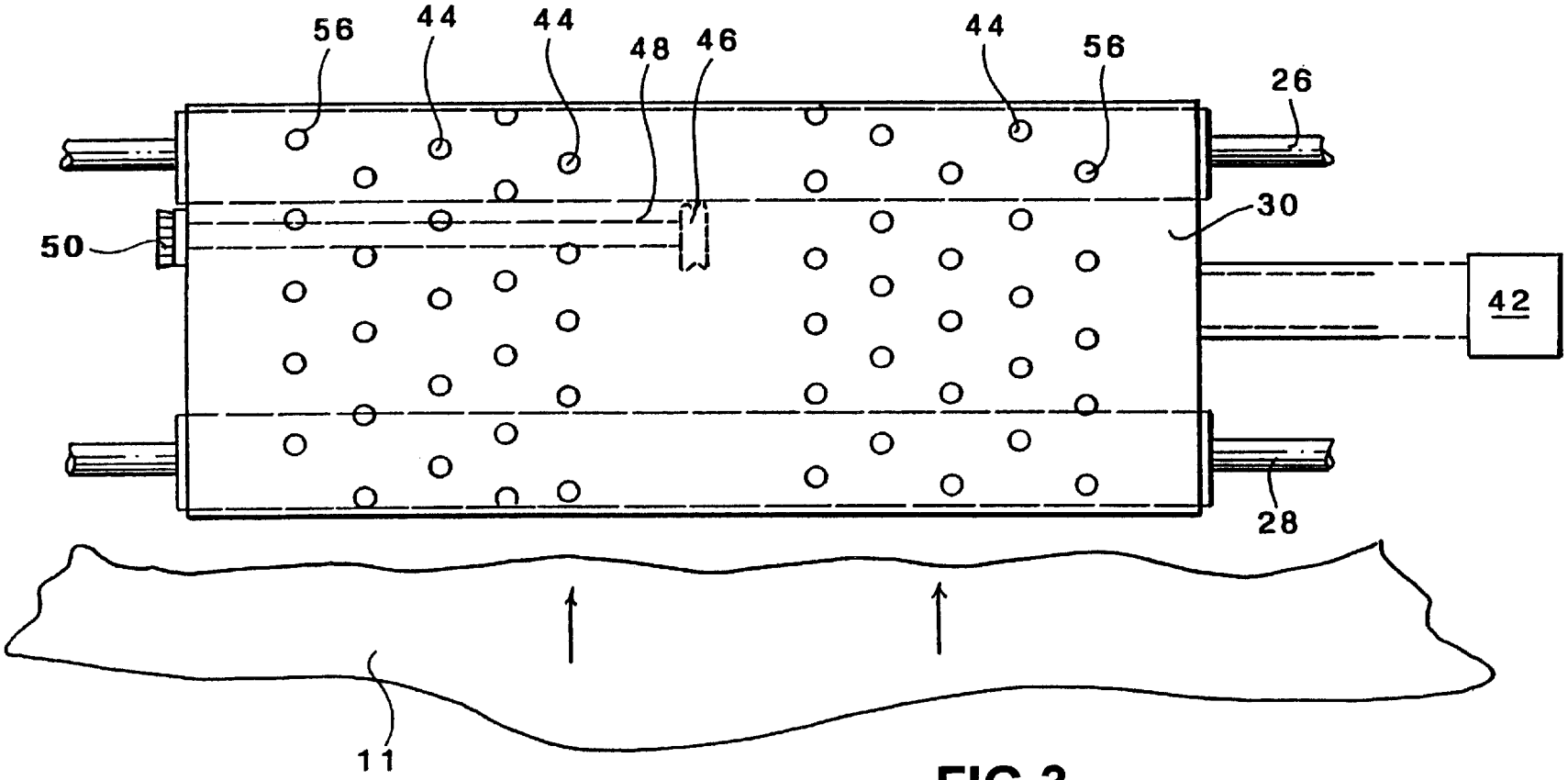
FIG. 3 is a view from below of the suction head comprising suction box and feed belt.

FIG. 2 shows the suction box 24 in greater detail. It consists of a rigid housing 38 which is provided with a connecting tube or pipe 40 which is connected to a vacuum device 42 (FIG. 3). The box is provided in its underside with slots, as will be described in more detail hereinafter. Around the box 24 runs the endless flexible belt 30 which has rows of perforations 44 running lengthwise of the box at regularly spaced intervals. The belt 30 is made of a material such as "Hyperlon" which is not too elastic, which has a good memory and does not generate static charges. Because the transverse width of the suction box 24 is approximately three times its length, the belt 30 is effectively a tube of material.

By the operation of the vacuum device 42 the pressure within the suction box 24 can be reduced, and by virtue of the registration of the perforations 44 with the slots a reduced pressure is created at the perforations. This means that if the suction head is positioned above the stack 12 of sheets, application of the suction will cause the top sheet to be attracted to the belt.

Positioned centrally across the width of the suction box 10 is a distortion wheel or roller 46 which is connected by a shaft 48 to an external adjusting knob 50. The wheel or roller 46 may be eccentrically mounted on the shaft 48 so that rotation of the adjusting knob 50 will cause a change in the eccentricity of the wheel or roller 46. The wheel 46 is preferably a grooved wheel, thus providing two circumferential ribs. The wheel or roller 46 projects from the bottom of the suction box and as it is rotated it increasingly distorts the central portion of the encompassing belt 30 adjacent to the leading edge of the box. It is to be noted that the corrugator 46 is within the belt 30. The amount of distortion of the belt is determined by the rotational position of the wheel or roller 46 and can be set in dependence upon the nature of the materials to be advanced from the stack. Sheets which are thin or difficult to separate will need a large hump, while stiff materials which are easier to separate need less distortion.

This distortion of the central zone of the belt 30, coupled with the suction effect created at the perforated zones of the belt means that as the top sheet in the stack 12 is lifted to the belt it has an undulation imparted to it. The distortion of the belt also contributes to the repelling of the next, underlying sheet of material in the stack, thereby helping to avoid double feeding.

In FIG. 2 the direction of movement of the sheets is indicated by arrows 52. The pattern of slots in the suction box, which work in conjunction with the corrugator 46, is important to the invention. As shown in FIG. 2, in each side of the box, i.e. on each side of the central corrugator, there are two outer slots 54*a*, 54*b* of equal length extending almost fully the length of the box, then a shorter slot 54*c*, and then a still shorter slot 54*d*. Slot 54*c* is about half the length of slots 54*a*, 54*b*, and slot 54*d* is about half the length of slot 54*c*. The slots all run from the leading edge of the box adjacent to the drive roller 26. This results in a chevron pattern of slots, with the area of the suction box behind and to the sides of the corrugator 46 being flat and imperforate. This prevents creasing of thin paper. The action of the chevron slot pattern is first to grip the sheet, via the aligned perforations 44, towards the outer edges of the suction box. Then, with actuation of the drive shaft 26, the belt and attracted sheet advance over the surface of the suction box. The shorter slots 54*c*, 54*d* provide added suction adjacent to the leading edge of the sheet to ensure that it is held to the belt at this edge in spite of the distortion introduced by the corrugator 46. In other words, this boost in suction is brought into effect at the time that the central portion of the sheet is distorted and might otherwise break away from the belt. The sheet is held more tightly at its leading edge when the central portion is distorted. The number, dimensions and position of the slots can be varied, provided that the leading edge boost is achieved.

In FIG. 3 the belt 30 is shown with five rows of perforations 44 on each side of the corrugator 46. The four inner rows on each side are aligned with the slots 54*a*, 54*b*, 54*c*, 54*d* and in the passage of the belt over the suction box the perforations will pass along the length of the respective slots. The outer row 56 of perforations on each side of the belt 30 is aligned with a "dummy" slot 58 in the suction box. This dummy slot 58 can be converted into a true slot, for wider sheets of material, by breaking away a thin web of material which initially closes the slot. If one is feeding narrow sheets then the outer slot or slots in the suction box can be masked by tape to make the suction more efficient. Although not so shown in FIG. 3, the sheet 11 in practice would be over the belt 30.

Figure 4:
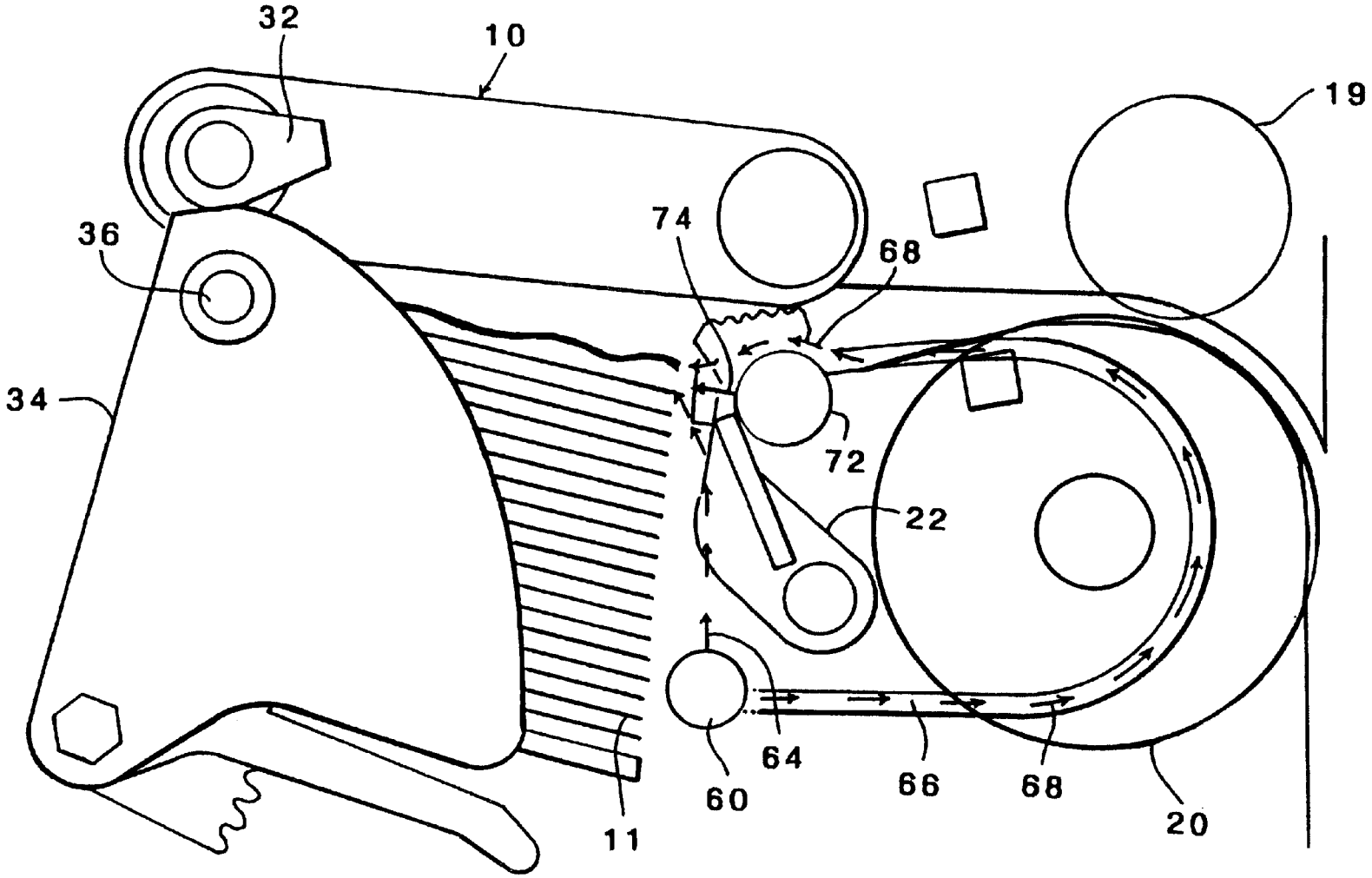
FIG. 4 is a schematic side view of parts of the feeder mechanism to illustrate the air flows for separation of the sheets; and, FIG. 5 is a diagrammatic plan view to illustrate how the air flows emanate from the air vents.

In order to achieve effective separation of the top sheet from the stack 12 it is important to use air flows. FIGS. 4 and 5 show how this is applied. FIG. 5 shows the parts in an exploded arrangement for clarity. Three different air flows are utilised. Running along the bottom of the stack 12 from side to side is an air pipe 60 which is provided with for example four holes 62 facing upwards and creating a constant upward air flow as indicated by the arrows 64 towards the margins of the sheets. From the air pipe 60 air is ducted by pipe 66 to emerge at the centre of the width of the stack in front of the topmost sheet, as indicated by arrows 68. This second, constant air flow emerges as two flows, one each side of a deflector 70 (FIG. 5), and directed one each side of the corrugator. The third air flow consists of air blasts, i.e. pulses of air, produced from two nozzles 72 positioned laterally outside the fingers 22 and directed at the leading edge of the top sheet. These air blasts are indicated by arrows 74. The combination of the air blast with the constant air flows results in excellent and reliable separation of the top sheet.

The pulsed air blasts from nozzles 72 are synchronised with the creation of the reduced pressure within the suction box. Also, the actuation of the drive for the drive shaft 26 is synchronised with the pump 42 which creates the reduced pressure, so that the advance movement of the belt, the suction effect and the pulsed air blasts are in the correct timed relationship.

Although in the embodiment illustrated in the drawings, the suction feeder is positioned above a stack of sheets, the same principle could be applied to an arrangement in which the suction feeder is positioned below a stack.

What is claimed is:

1. A suction device for use in the feeding of sheets of material, comprising a housing connectable to a vacuum device and having a flat surface provided with apertures through which a suction effect can be created to attract a sheet towards said surface and having a sheet discharge edge, an endless perforated belt on which the sheet is held encompassing the housing and arranged for intermittent advancing movement, and means prominent from said surface to impart distortion to an attracted sheet at a zone spaced from the sheet discharge edge of the housing, wherein the apertures in said surface are are of chevron shape overall such that they permit, by their surface area, the suction exerted on the attracted sheet to be greater in the direction towards the said sheet discharge edge, and to attract the sheet most strongly across its width at the zone where it is distorted.

2. A suction device according to claim 1, in which the distortion-imparting means is adjacent to the sheet discharge edge of the housing from which the sheet is fed onwards, and the surface area of said apertures is greatest along a line extending laterally across the housing to each side of said distortion-imparting means.

3. A suction device to claim 1, in which the apertures comprise a plurality of parallel slots, with longer slots towards the outside edges of the housing and shorter slots towards the center.

4. A suction device according to claim 3, in which there are four slots on each side of a central distortion-imparting means, the two outer slots on each side being of equal length, the next inner slot being approximately half the length and the innermost slot being approximately half the length again.

5. A suction device according to claim 1, in which the distortion-imparting means comprises a roller eccentrically mounted on a shaft extending across the housing, the roller being positioned centrally across the width of the housing and being rotatably adjustable due to the rotation of the shaft to vary the amount the roller projects from said flat surface.

6. A suction device according to claim 1, in which the ratio of the transverse width of the housing to its length is approximately 3 to 1.

7. A suction device according to claim 1, in which a portion of the flat surface to the rear of and to each side of the distortion-imparting means is imperforate.

8. A suction head for use in the feeding of sheets of material, comprising a suction device according to claim 1.

9. A suction head according to claim 8, in which the belt also extends over the distortion-imparting means.

10. A sheet feeding mechanism comprising a suction head as claimed in claim 8, means to support a stack of sheets adjacent to the belt, and a vacuum device connected to the housing and synchronized to operate in conjunction with advancing movements of the belt.

11. A sheet feeding mechanism according to claim 10, in which the means to support the stack of sheets holds the sheets at an inclined feed angle relative to an adjacent run of the belt.

12. A sheet feeding mechanism according to claim 11, in which the feed angle is adjustable.

13. A sheet feeding mechanism according to claim 11, in which the feed angle is between 5° and 15°.

14. A sheet feeding mechanism according to claim 10, which includes air supply means to provide both a pulsed and a continuous flow of air towards the stack of sheets.

15. A sheet feeding mechanism according to claim 14, in which a first continuous air flow is directed upwards at the leading edge of the stack, a second continuous air flow is directed towards the top sheet of the stack substantially parallel thereto, and a pulsed air flow is directed towards the leading edge of the top sheet in synchronism with the operation of the vacuum device and with the belt movements.

16. A sheet feeding mechanism according to claim 15, in which the pulsed air flow is positioned between said first and second air flows on each side of the distortion-imparting means.

17. A suction device for use in the feeding of sheets of material, comprising a housing connectable to a vacuum device and having a flat surface provided with apertures through which a suction effect can be created to attract a sheet towards said surface and having a sheet discharge edge, and endless perforated belt on which the sheet is held encompassing the housing and arranged for intermittent advancing movement, and means prominent from said surface to impart distortion to an attracted sheet at a zone spaced from the sheet discharge edge of the housing, said means comprising a roller eccentrically mounted on a shaft extending across the housing, the roller being positioned centrally across the width of the housing and being rotatably adjustable due to the rotation of the shaft to vary the amount the roller projects from said flat surface, wherein the apertures in said surface are arranged such that they permit, by their surface area, the suction exerted on the attracted sheet to be greater in the direction towards the said sheet discharge edge, and to attract the sheet most strongly across its width at the zone where it is distorted.

* * * * *